United States Patent [19]

Engels et al.

[11] 4,129,261

[45] Dec. 12, 1978

[54] AGITATING MILL

[75] Inventors: Kaspar Engels, Mannheim; Karlheinz Wilhelm, Bobstadt, both of Germany

[73] Assignee: Draiswerke GmbH, Mannheim-Waldhof, Germany

[21] Appl. No.: 811,184

[22] Filed: Jun. 29, 1977

[30] Foreign Application Priority Data

Jun. 30, 1976 [DE] Fed. Rep. of Germany ..... 2629251

[51] Int. Cl.[2] ..... B02C 17/16

[52] U.S. Cl. ..... 241/46.11; 241/67; 241/172

[58] Field of Search ..... 241/46.06, 46.11, 46.15, 241/46.17, 66, 67, 172, 173

[56] References Cited

U.S. PATENT DOCUMENTS

| | | | |
|---|---|---|---|
| 2,779,752 | 1/1957 | Vining | 241/172 |
| 3,539,117 | 11/1970 | Sjogren | 241/172 |
| 3,993,254 | 11/1976 | Bicik et al. | 241/67 |
| 4,059,232 | 11/1977 | Engels | 241/46.17 |

*Primary Examiner*—Howard N. Goldberg
*Attorney, Agent, or Firm*—Browdy and Neimark

[57] ABSTRACT

An agitating mill in whose cylindrical grinding container a mixing shaft is disposed, is to be partially filled with grinding media. The mixing shaft is made hollow and coolable. Substantially radially projecting discs are mounted on the mixing shaft, with mixing bars fastened to the discs. The discs can be made in the form of coolable hollow discs.

10 Claims, 2 Drawing Figures

AGITATING MILL

BACKGROUND OF THE INVENTION

This invention relates to an agitating mill having a cylindrical grinding container, whose grinding space is partially filled with grinding media, and a rotatably drivable mixer mounted concentrically therein. The present invention relates more particularly to such an agitating mill having a mixer provided with hollow mixing shaft and mixing bars mounted extending approximately radially outward therefrom, the grinding container being provided with a grinding-stock inlet and a ground-stock outlet.

An agitating mill of this type is known from Swiss Pat. No. 132,086, wherein the mixing bars serve to impart pulsed movements to the grinding media contained in the grinding container. The continuous acceleration and braking of the grinding media causes the particles of grinding stock, in the form of a suspension or a dispersion, to be ground between the grinding media. The mixing shaft, made hollow in the known agitating mill, is used to add the liquid grinding stock. The crushing and dispersion effect is not optimal in this known agitating mill, i.e. especially during continuous operation, the insufficiently crushed particles of grinding stock must be separated by sedimentation and recycled into the grinding space.

It is already known from German Pat. No. 1,214,516 to provide in the grinding container, a closed cylinder extending over the entire length of the container and to provide mixing bars in the annular space formed by the outside wall of the cylinder and the inside wall of the grinding container. The hollow cylinder is coolable. The purpose of this design is to achieve a homogeneous ground product by means of a maximally homogeneous movement throughout the entire system of the grinding stock and grinding media. In the narrow annular space, the grinding media should be able to move without significant differences in velocity. Starting agitating mills of this known type has proven to be especially difficult.

German Auslegeschrift No. 1,211,905 discloses an agitating mill in which mixing elements in the form of solid mixing discs are provided on the mixing shaft, wherein the shape of the outside edges of the mixing discs is not circular and differs from a circular cross section. An agitating mill of this type is well suited for the preparation of solid dispersions in liquids with approximately Newtonian behavior; this agitating mill is less suitable for liquids with considerably different behaviors. Moreover, a relatively poor cellular flow is produced in this known agitating mill in the areas between adjacent the mixing discs.

SUMMARY OF THE INVENTION

It is the principal object of the present invention to provide an agitating mill of the type described hereinabove such that good peak load distribution and, in particular, higher grinding efficiency are achieved.

The foregoing object, as well as others which are to become clear from the text below, are achieved according to the invention by virtue of the fact that discs projecting approximately radially are mounted on the coolable mixing shaft, with mixing bars mounted on said discs. By virtue of this combination of discs mounted on the relatively slender mixing shaft with mixing bars, a three-dimensional grinding phenomena is achieved. The grinding media can move not only axially and tangentially, but also radially, i.e., they can be deflected from the radially outwardly located area of the grinding space, where they are largely given positive acceleration impulses by the mixing bars, into the spaces between the axially adjacent discs. This results in an improved distribution of the peak load, which has an advantageous effect upon starting the agitating mill. Hence, jamming of the agitating mill when starting is eliminated. A plaited flow is generated in the agitating mill when practising the invention as in a pure disc mill. There is no constant velocity distribution over the radius of the grinding space, so that no constant velocity gradient and therefore no constant shear rate develops. This results in a higher hydrodynamic shear stress on the grinding stock, which in turn results in higher grinding efficiency with respect to the fineness of the grinding and/or the throughput of grinding stock per unit time. The agitating mill according to the invention is consequently especially suited for liquids which differ markedly from Newtonian behavior.

A further increase in the velocity gradients and consequently in the hydrodynamic shear stress is achieved by providing in known fashion opposing bars extending approximately radially into the grinding space from the walls of the container, the bars exerting negative acceleration impulses upon the grinding media. Moreover, optimization of the cooling is possible especially if, according to an advantageous embodiment of the invention, the discs are made in the form of coolable hollow discs. If the opposing bars overlap radially with the discs, in other words if they project into the space between two adjacent discs, the shear forces become especially high, since the cooling between the discs and the shaft is especially intensive, thus resulting in an increase in the viscosity of the grinding stock.

DETAILED DESCRIPTION OF THE PREFERRED EMBODIMENT

Figure 1:
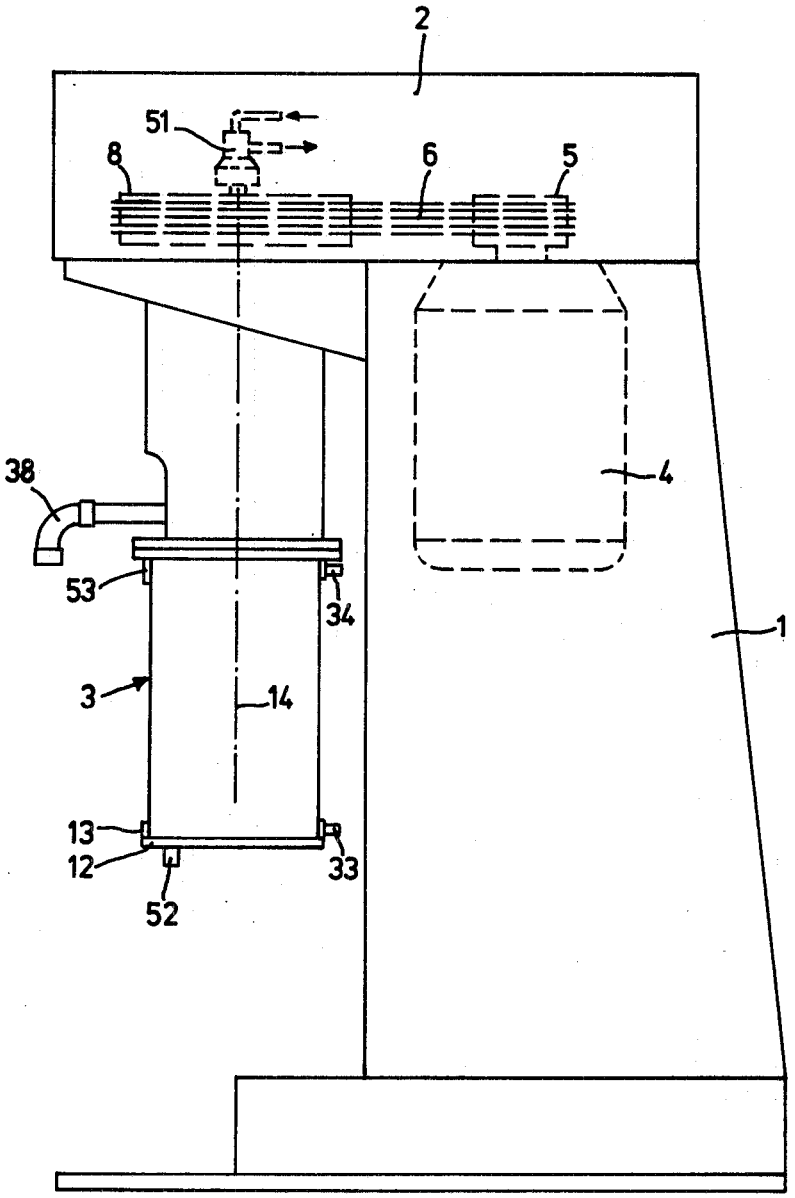
FIG. 1 is a side view of an exemplary embodiment of an agitating mill according to the present invention.

The agitating mill in the drawing is provided in usual fashion with a base 1, to whose upper side a projecting bracket 2 is mounted, to which a cylindrical grinding container 3 is fastened in turn. An electric drive motor 4 is mounted in the base 1, this motor being provided with a V-belt pulley 5, by means of which a V-belt pulley 8 is rotatably drivable, this pulley being nonrotatably connected by a V-belt 6 with a mixer 7.

The grinding container 3 includes a cylindrical internal cylinder 10 surrounding a grinding space 9 and simultaneously forming the wall of the grinding container, this cylinder being surrounded in turn by an essentially cylindrical cooling jacket 11. The lower closure of the grinding space 9 and the cooling jacket 11 is provided by a bottom plate 12, this plate being fixedly attached to the inside cylinder 10 and the cooling jacket 11 for example by welding. A grinding-stock inlet connection 13 is provided on the bottom plate 12, through which the grinding stock can be pumped from below into the grinding space 9.

The mixer 7, mounted concentrically in the grinding container 3, includes a tube forming a mixing shaft 14, with discs 15, in the form of hollow discs, being mounted on the tube concentrically and projecting radially in a nonrotatable fashion. The discs include an upper, annular, thin plate 16, to which a downwardly projecting, circularly cylindrical outer ring 17 and a similar downwardly projecting hub 18 are mounted, the hub surrounding the mixer shaft 14 in a sealing manner. The upper plate 16 with the outer ring 17 and the hub 18 can be made integral. The plate 16 is connected nonrotatably to the mixing shaft 14 by means of a key connection 19. A hollow space 20, delimited by the outer ring 17, the hub 18, and the upper plate 16, is closed at the bottom by a lower plate 21, to which a tubular spacer 22 is connected, this spacer surrounding the mixing shaft 14 with clearance and resting with its free end on the upper side of the next lower upper plate 16. By virtue of this design, the hollow discs 15 can be assembled on the mixing shaft 14 by simply sliding them into place. Sealing rings 23, 24 are provided between the exposed end faces of the spacers 22 and an associated upper plate 16 and between the free edge of the outer ring 17 and the corresponding side of a lower plate 21. The annular space 25 surrounded by each of the spacers 22 and the corresponding section of the mixing shaft 14 is connected by one or more holes 26 in the upper plate 16 with the hollow space 20 of the next lower disc 15, whereby the hole 26 is provided in the vicinity of the hub 18. Furthermore, a conducting disc 27 is mounted on each hub 18, this individual disc extending radially outward and projecting as far as the vicinity of the outer ring 17. No spacer is provided on the lowest disc 15' of the mixer 7. Here, a hole 28 of the mixer shaft 14 communicates directly with the hollow space on the disc through a cross bore 28'.

By virtue of this design, cooling water flowing downward through the bore 28 can flow through the cross bore 28' into the hollow space 20 of the lowermost disc 15' and thence upward, whereby it flows through one hole 26 into a respective annular space 25 and thence through one or more holes 26' in one lower plate 21 into a respective hollow space 20 and thence around a guide disc 27 to the next higher hole 26. By virtue of this design, an extraordinarily intensive cooling of the discs 15 and of the spacers 22 surrounding the mixing shaft 14 is insured. A plurality of mixing bars 29 is fastened to the outer ring 17 of each disc 15 in a radially projecting fashion, for example by screwing, welding or the like, these bars capable of being provided with a bore 30 open to the hollow space 20, whereby the cooling of these mixing bars 29 is still further improved.

Opposing bars 31 are mounted on the inner cylinder 10, these bars projecting radially into the grinding space 9, these bars further being mounted axially in such manner that they are always located between two axially adjacent mixing bars 29. In the usual design, shown at the left in FIG. 2, the opposing bars 31 are made only so long that they do not overlap radially with discs 15. In addition, the opposing bars 31 can be provided with a bore 32 which is open to the cooling jacket 11. On the cooling jacket 11, a lower cooling water inlet connection 33 and an upper cooling water outlet connection 34 are provided.

Figure 2:
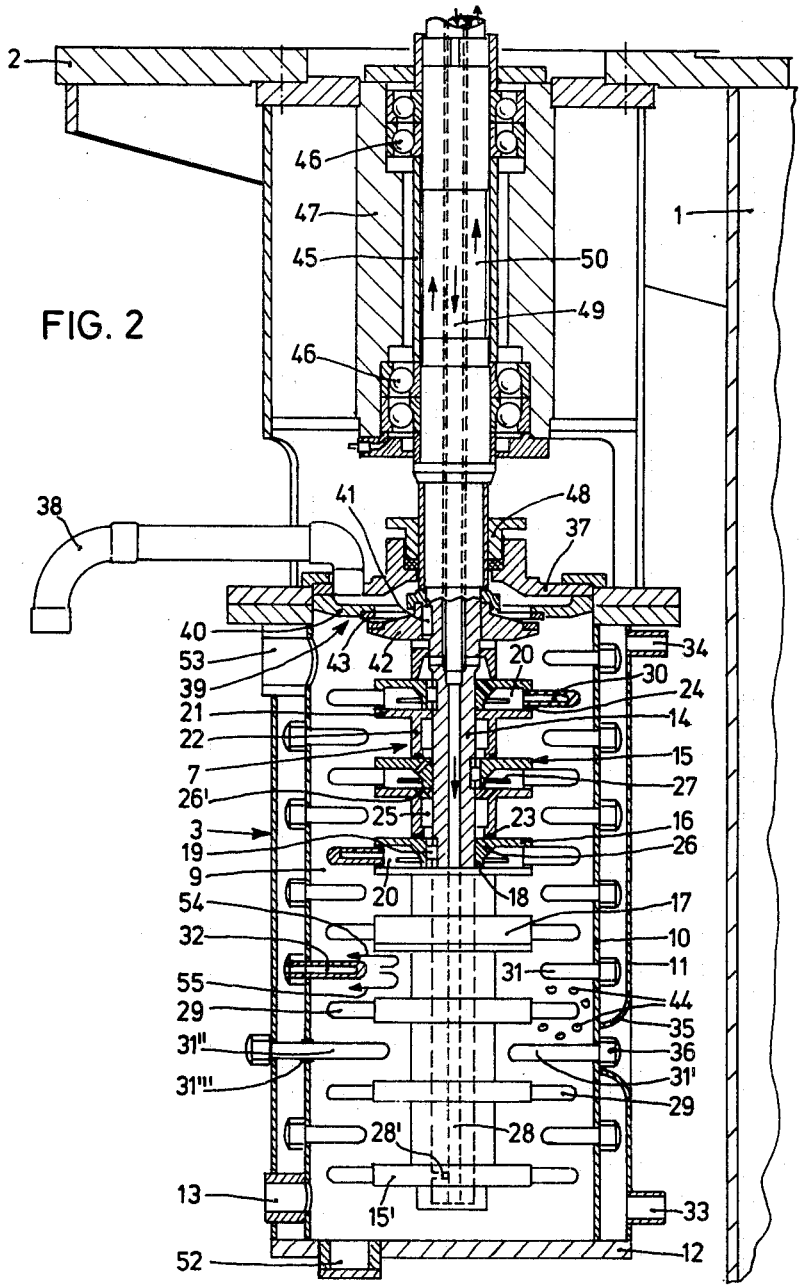
FIG. 2 is a vertical cross section through the grinding container of the agitating mill illustrated in FIG. 1.

If, as is shown in FIG. 2 at the right, the opposing bars 31 are made sufficiently long that they overlap radially with the adjacent disc 15, it is advantageous to provide the cooling jacket 11 with an indentation 35 extending up to inside the cylinder 10 at the point of attachment of such an opposing bar 31', so that the head 36 of opposing bar 31' is exposed to the outside, so that an opposing bar 31' can be removed in simple fashion from the grinding container 3 if for example the mixer 7 must be removed from the container. With reference to a lower disc 15' in FIG. 2, it is shown that the disc 15' can be made very flat. The outside diameter of the discs 16 and/or 15' is approximately 0.5 to 0.6 times that of the diameter of the grinding space 9. Accordingly, the length of the mixing bars 29 is 0.12 to 0.18 times the diameter of the grinding space 9. The free length of the opposing bars 31 is 0.15 to 0.24 times that of the diameter of the grinding space 9, while the free length of opposing bars 31' is 0.25 to 0.35 times the diameter of the grinding space 9.

The grinding container 3 is closed at its upper side with a flanged cover 37, to which a ground-stock outlet pipe 38 is connected. A separator 39 is connected ahead of the ground-stock outlet pipe 38, the separator including a ring 40 mounted on the inside of the cover 37 and an annular disc 42 mounted by a key connection 41 to the mixer shaft 14, whereby an at least partially radially extending annular space 43 is formed in the area of overlap of the ring 40 and the annular disc 42, by means of which the grinding media 44 located in the grinding space 9 and merely indicated in the drawing, the media filling the grinding space 9 by 50 to 70%, can be retained. Simultaneously, the liquid ground stock which emerges is subjected to additional frictional and shearing treatment, resulting in a further improvement of the grinding effect. Such a separator, which produces the additional effect mentioned, is described in detail in U.S. Pat. No. 3,311,310.

The mixing shaft 14 is extended upward in a conventional manner by a tubular shaft 45, mounted in bearings 46, the bearings being supported in turn in a bearing block 47, mounted in the bracket 2. Hence, the mixing shaft 14 is mounted in a suspended fashion. The mixing shaft 45 is sealed off from the cover 37 by a stuffing-box seal 48. The V-belt pulley 8 is mounted at its upper end. A cooling water supply pipe 49 runs concentrically through the tubular shaft 45, this pipe being connected to the tubular member which forms the mixing shaft 14. The cooling water is returned through the annular channel 50 between the cooling water supply pipe 49 and the tubular shaft 45. At the upper end of the tubular shaft 45, in other words above the V-belt pulley 8, a conventional pipe coupling 51 is provided to add and/or remove the cooling water.

The entire grinding container 3 is suspended from the bracket 2.

A closable drain connection 52 for the grinding media 44 is provided in the bottom plate 12 of grinding container 3. A filling connection 53 for these grinding media 44 is provided in the vicinity of the upper end of grinding container 3.

Alternatively to the opposing bars 31', overlapping radially with two adjacent discs 15, opposing bars 31'' can also be provided, which are pushed through the cooling jsacket 11 and the inner cylinder 10 into the grinding space 9 sufficiently far that their free ends overlap with the discs 15 and/or 15'. In this type of removable assembly, they are sealed by means of seals 31''' from the inner cylinder 10.

The plaited flow mentioned hereinabove, which is created between the discs 15 and/or 15', is indicated by arrows 54, 55 in FIG. 2 indicating the direction of flow.

It is to be understood that the foregoing text and accompanying drawing figures relate to an embodiment of an agitating mill given by way of example, not by way of limitation. Various other embodiments and numerous variants are possible within the spirit and scope of the invention, its scope being defined by the appended claims.

What is claimed is:

1. In an agitating mill with a cylindrical grinding container defining a grinding space, and with a rotatable drivable mixer mounted concentrically therein, the mixer including a hollow mixing shaft having an axis and mixing bars projecting substantially radially with respect to said axis into said grinding space, the container having a grinding stock inlet means and groundstock outlet means, the improvement comprising radially projecting discs mounted on said hollow mixing shaft, said mixing bars being fastened to said discs; and a grinding media partially filling said grinding space.

2. An improved agitating mill according to claim 1, including opposing bars mounted on the container and projecting approximately radially into said grinding space.

3. An improved agitating mill according to claim 1, wherein said discs are made in the form of hollow discs defining hollow spaces in fluid communication with the interior of said hollow shaft whereby cooling fluid can be fed to the hollow spaces of said discs.

4. An improved agitating mill according to claim 3, including conducting discs disposed individually in respective ones of said hollow spaces within said hollow discs.

5. An improved agitating mill according to claim 1, including opposing bars which are spaced from and radially overlap said discs.

6. An improved agitating mill according to claim 5, including a cooling jacket about said grinding container.

7. An improved agitating mill according to claim 6, wherein said cooling jacket is recessed in the vicinity of the point of attachment of said opposing bars to a wall of said grinding container.

8. An improved agitating mill according to claim 5, including a cooling jacket about said container and wherein said opposing bars penetrate said cooling jacket from outside.

9. An improved agitating mill according to claim 1, including a cooling jacket about said container, and opposing bars mounted on the container and projecting into said grinding space, said bars being hollow and open to said cooling jacket.

10. An improved agitating mill according to claim 1, including means for feeding cooling fluid to the interior of said hollow shaft.

* * * * *